US005788543A

United States Patent [19]

Rudoy et al.

[11] Patent Number: 5,788,543

[45] Date of Patent: Aug. 4, 1998

[54] HIGH POWER CLIP-ON INTERCONNECTION SYSTEM

[75] Inventors: Edward Rudoy, Woodland Hills; John Steven Szalay, Corona Del Mar, both of Calif.

[73] Assignee: Packard Hughes Interconnect Company, Irvine, Calif.

[21] Appl. No.: 525,240

[22] Filed: Sep. 8, 1995

[51] Int. Cl.[6] ..... H01R 11/22

[52] U.S. Cl. ..... 439/854; 439/881

[58] Field of Search ..... 439/854, 881, 439/856, 855, 860, 268, 833, 834, 835, 836, 837, 829

[56] References Cited

U.S. PATENT DOCUMENTS 1,877,830 9/1932 Eyrick ..... 439/829

3,753,193 8/1973 Teagno et al. ..... 439/854

3,777,302 12/1973 Travis ..... 439/854

FOREIGN PATENT DOCUMENTS 2615662 11/1988 France ..... 439/881

*Primary Examiner*—Gary F. Paumen

*Assistant Examiner*—Tho Dac Ta

*Attorney, Agent, or Firm*—Cary W. Brooks

[57] ABSTRACT

The high power clip-on interconnection system of the present invention includes a terminal stud, clip terminal and cable. The clip is formed out of flat conductive material with good spring characteristics. The clip has a terminal end for securing to a cable, an adjustable diameter circular-shaped portion for securing to the stud, and an activation arm for adjusting the diameter of the circular-shaped portion.

4 Claims, 1 Drawing Sheet

HIGH POWER CLIP-ON INTERCONNECTION SYSTEM

FIELD OF THE INVENTION

This invention relates to high power interconnection systems, and more particularly to systems utilizing a stud terminal.

BACKGROUND OF THE INVENTION

Numerous interconnection systems for high power applications currently exist. Many of these interconnection systems utilize a threaded stud and a ring terminal lug that is retained by a nut. These systems require tools to install or remove the terminal and have a relatively high cost and are labor intensive in terms of manufacturing and assembling.

The present invention provides advantages over the prior art.

SUMMARY OF THE INVENTION

The high power clip-on interconnection system of the present invention includes a terminal stud, clip terminal and cable. The clip terminal is formed out of flat conductive material with good spring characteristics. The clip terminal has a termination end for securing to a wire or cable, an adjustable diameter circular-shaped portion for securing to the stud, and an activation arm for adjusting the diameter of the circular-shaped portion.

These and other objects, features and advantages of the present invention will become apparent from the brief description of the drawings, detailed description and appended claims and drawings.

DETAILED DESCRIPTION

Figure 1:
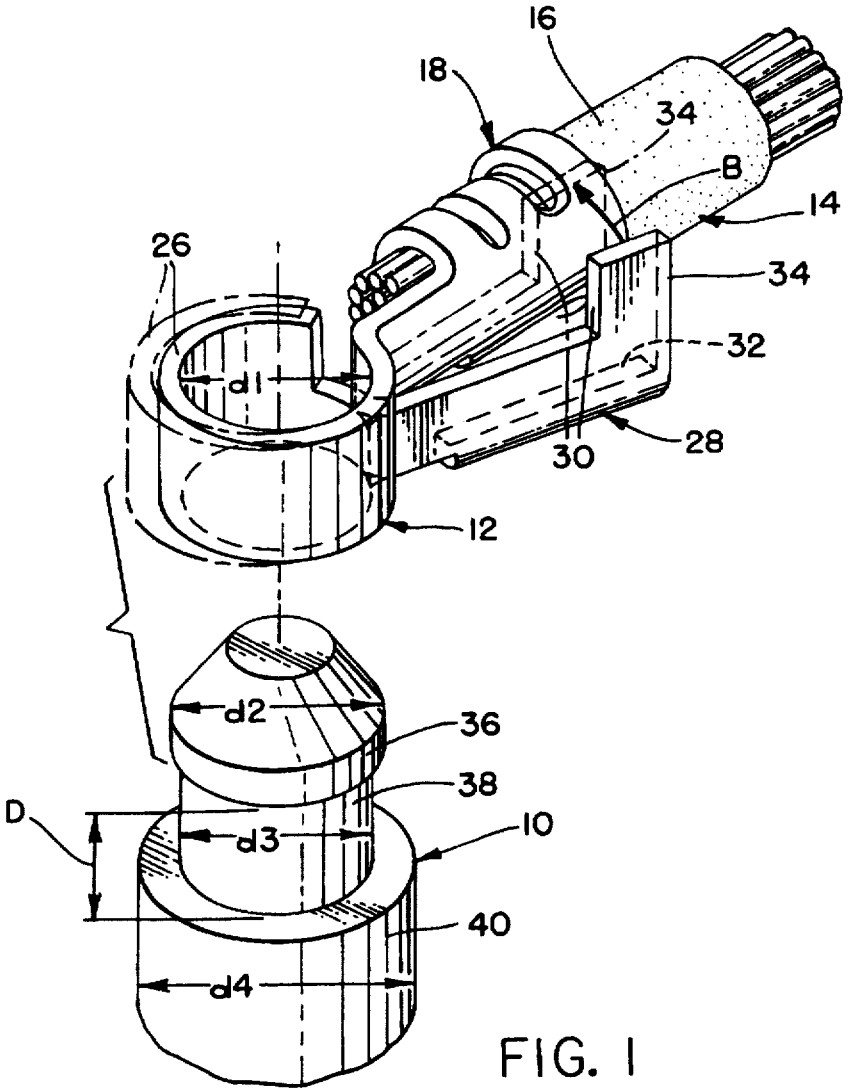
FIG. 1 illustrates a high power clip-on interconnection system according to the present invention including a stud terminal, clip terminal and cable.
Figure 2:
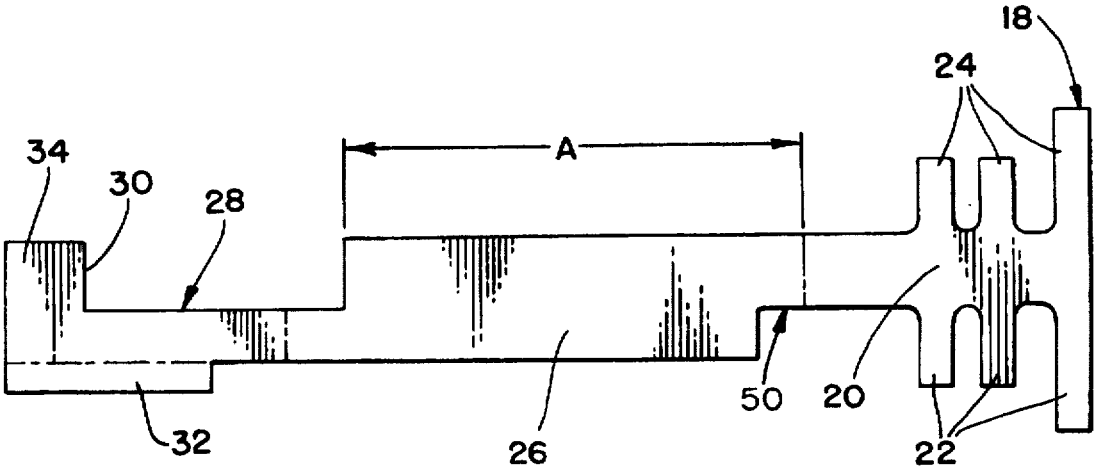
FIG. 2 illustrates a stamp design from which the clip terminal according to the present invention is formed.

FIG. 1 illustrates a high power clip-on interconnection system according to the present invention including a stud terminal 10, a clip terminal 12 and cable 14 having an insulative coating 16 thereon. FIG. 2 illustrates a stamped single piece of conductive material from which the clip terminal according to the present invention is formed. Again the clip terminal is a stamped and formed from a single piece of material without separate pieces which have been welded or secured together. The clip terminal has a termination end 18 for securing to the cable 14. The termination end 18 may have a variety of configurations for attachment to a wire or cable by way of solderless wire crimp, bus bar, solder, etc. FIG. 1 and FIG. 2 shows a preferred termination end 18 which is in a "F" crimped shaped. In the preferred embodiment the termination end 18 has an elongated portion 20 which has a plurality of outwardly extending fingers 22, 24 respectively extending from opposite sides of the elongated portion. The outwardly extending fingers, 22, 24 are crimped around the wire or cable 14. The terminal clip also includes a mid-section 26 or section "A" attached to the termination end 18 and is formed into a circular or cylindrical shape. An activation arm 28 extends from the mid-section and has a first notched section 30 formed in an upper edge of the stamping adjacent the mid-section 26, and a second notched section 50 formed in at lower edge of the stamping adjacent the termination end 18 and distant from the first notched section 30 so that the activation arm 28 can be moved towards the termination end 18 by crossing the first notched section under the second notched section and the activation arm passed the termination end 18. A tab 32 may be provided extending outward from the activation arm and bent at an angle thereto to provide rigidity and stiffness to the activation arm. A hand 34 may be provided which extends upward at a substantial right angle to the activation arm 28. As shown in FIG. 1, the mid-section 26 has a diameter d1.

The terminal stud has a head portion 36 having a diameter d2, a body portion 38 or section D having a diameter d3 and a base portion 40 having a diameter d4. The terminal stud is constructed and arranged so that the diameters of d2 and d4 of the head portion and base portion respectively are greater than the diameter d3 of the mid-section 38.

When the clip terminal 12 is in its natural or relaxed state, the activation arm 28 is placed a distance from the termination end 18 and the mid-section 26 has a diameter equal to or less than the diameter d3 of the body portion 38 of the terminal stud. When the activation arm 28 is moved along line B toward the termination end 18, the clip terminal is in a loaded or energy storing state and the diameter of the mid-section 26 is greater than the diameter d2 of the head portion 36 of the stud terminal. To engage the terminal contacts, activation arm 28 is depressed along path B towards termination end 18. Again, this action will increase the diameter d1 of the mid-section 26 of the terminal clip until the diameter is larger than the diameter d2 of the head portion 36 of the terminal stud 10. The mid-section of the terminal clip is slid over the head portion of the terminal stud into the body portion 38 of the terminal stud. By releasing the activation arm 38, the spring characteristics of the terminal clip causes the mid-section 26 to wrap around the body portion 38 of the terminal stud to provide electrical contact.

What is claimed is:

1. A high power clip-on interconnection system comprising:

a stud terminal and a clip terminal;

said terminal having a head portion having a first diameter, a body portion connected to the head portion, said body portion having a second diameter, and a base portion connected to the body portion, said base portion having a third diameter, and wherein the diameter of the head portion and the base portion are greater than the diameter of the body portion;

said clip terminal being made from a single piece of stamped and formed material having a good spring characteristic and comprising a termination end for securing to a conductive cable, a middle section having a second notched section formed at one end at a lower edge of the stamped material and connected to the termination end, and an activation arm connected to the middle section, said activation arm having a first notched section formed in an upper edge of the stamped material and said first notched section of the arm being crossed under the second notched section of the middle section and so that the activation arm is moved passed the termination end and so that a portion of the middle section has a circular shape, said clip being constructed and arranged so that said activation arm is movable from a first position, spaced distance from the termination end wherein the clip terminal is in a relaxed state and the circular-shaped portion of the middle section has a diameter equal to or less than the diameter of the body portion of the stud terminal, to a second position immediately adjacent said termination end and wherein said clip terminal is in a loaded energy storing state and the diameter of the circular shaped portion of the middle section is greater than the diameter of the head portion of the terminal stud so that the circular shaped portion of the middle section is slidable over the head portion, and upon release of the activation arm the diameter of the circular shaped portion of the middle section is decreased and the circular shaped portion of the middle section wraps around the body portion of the terminal stud to lock the clip terminal in place.

2. A high power clip-on interconnection system as set forth in claim 1 wherein said activation arm includes an outwardly extending tab bent at an angle to provide stiffness to the activation arm.

3. A high power clip-on interconnection system as set forth in claim 1 wherein said termination end of the clip terminal has a "F" shape and includes an elongated portion having a plurality of outwardly extending fingers from each side of the elongation portion.

4. A high power clip-on interconnection system as set forth in claim 1 further comprising a conductive cable secured to the termination end of the clip terminal.

* * * * *